United States Patent [19]

Yamada et al.

[11] Patent Number: 4,646,536

[45] Date of Patent: Mar. 3, 1987

[54] REFRIGERATION WITH AUTOMATIC DEFROST AND RAPID COOLING

[75] Inventors: Teturo Yamada; Hikaru Nonaka, both of Osaka, Japan

[73] Assignee: Kabushiki Kaisha Toshiba, Kawasaki, Japan

[21] Appl. No.: 784,898

[22] Filed: Oct. 7, 1985

[30] Foreign Application Priority Data

Oct. 5, 1984 [JP] Japan ..... 59-210132

[51] Int. Cl.[4] ..... F25D 21/00

[52] U.S. Cl. ..... 62/234; 62/157

[58] Field of Search ..... 62/157, 158, 155, 231, 62/234, 161, 162, 163, 164

[56] References Cited

U.S. PATENT DOCUMENTS 4,389,854 6/1983 Ogita et al. ..... 62/163 X
4,499,738 2/1985 Motoyama et al. ..... 62/157 X
4,569,205 2/1986 Dempou et al. ..... 62/155

FOREIGN PATENT DOCUMENTS 0003288 1/1984 Japan .

*Primary Examiner*—Harry Tanner
*Attorney, Agent, or Firm*—Cushman, Darby & Cushman

[57] ABSTRACT

A control circuit for a refrigerator in which the compressor is operated in a pre-cool cycle prior to automatic defrost and in a rapid cooling mode. The control circuit defrosts immediately following rapid cooling when a defrost signal is produced during rapid cooling.

4 Claims, 3 Drawing Figures

REFRIGERATION WITH AUTOMATIC DEFROST AND RAPID COOLING

BACKGROUND OF THE INVENTION

The present invention relates to refrigerators, and in particular, to refrigerators which defrost after a forced pre-cooling.

Construction of a well known prior art refrigerator is shown in FIG. 1. Such refrigerator is formed with an outer cabinet 3 and inner cabinet 5. Outer cabinet 3 and inner cabinet 5 establish a heat insulation chamber 7 which is filled with a heat insulation material. The inside of inner cabinet 5 is divided into two chambers. One is a freezing chamber 9 and the other is a refrigerating chamber 11 with a partition wall 13 therebetween. An evaporator 10 and a fan-motor 12 are provided within a cooling chamber 15, which is located between partition wall 13 and the bottom surface 17 of freezing chamber 9. A shelf 19 is supported at the upper part of freezing chamber 9.

One end 23*a* of a first cooling path 23 opens into freezing chamber 9 while the other end 23*b* thereof opens into cooling chamber 15. Second cooling path 25 is formed at the back of refrigerating chamber 11 such that one end 25*a* thereof opens into cooling chamber 15 while the other end 25*b* thereof communicates with refrigerating chamber 11 through a damper 27. Damper 27 is a conventional temperature controller which regulates the temperature of refrigerating chamber 11. A third cooling path 29 is provided at the front of cooling chamber 15 to communicate cooling chamber 15 with freezing chamber 9. Thus, a first air circulation path is established so that cooled air flows from cooling chamber 15 through first cooling path 23 to freezing chamber 9 and then returns to cooling chamber 15 via third cooling path 29.

Cooling path 31 is also provided at the front of cooling chamber 15 to communicate cooling chamber 15 with refrigerating chamber 11. Thus, a second air circulation path is also established so that cooled air flows from cooling chamber 15 to refrigerating chamber 11 through second cooling path 25 and damper 27 and then returns to cooling chamber 15 via fourth cooling path 31.

Several shelves 33 are provided in parallel with each other within refrigerating chamber 11, and a vegetable case 35 is slidably provided on the bottom part of refrigerating chamber 11. A compressor unit 37 is provided on the bottom rear portion below refrigerating chamber 11 to supply coolant to the evaporator 10 via suitable conduits (not shown). Freezing chamber 9 and refrigerating chamber 11 are opened and closed by individual doors 39 and 40 provided in front thereof. Each door 39 and 40 is provided with individual handles 39*a* and 40*a* on the front surfaces thereof.

The above-described refrigerator has two cooling functions, that is, a regular cooling function and a rapid cooling function.

In the regular cooling operation, refrigerating chamber 11 and freezing chamber 9 are each automatically controlled to its individual predetermined temperature.

In the rapid cooling operation, cooled air is provided only to freezing chamber 9 when a user manually commands this function. The temperature of freezing chamber 9 therefore goes down quickly under −40° C. within prescribed minutes to freeze food rapidly.

After a certain period of usage, frost may accumulate on evaporator 10 and defrosting is carried out automatically. Conventional defrosting will be described as follows.

As can be seen in line A of FIG. 2, before the defrost operation begins, a pre-cooling operation is carried out to cool refrigerating chamber 9 to a prescribed temperature, compensating for the temperature which will rise while defrosting is carried out. This is accomplished by driving the compressor 37 forcibly for a prescribed period of time. In this case, if a user commands the rapid cooling operation when the pre-cooling operation is being carried out, the rapid cooling operation is carried out in preference to the pre-cooling operation. After the completion of the rapid cooling operation, the pre-cooling operation is re-executed for only the remaining period of time as is shown in line B of FIG. 2. If the precooling operation is intended to begin when the rapid cooling operation is being carried out, the rapid cooling operation is carried out in preference to the pre-cooling operation, and then the pre-cooling operation is executed later. After the pre-cooling operation is completed, defrosting is carried out until the temperature of the evaporator reaches a prescribed temperature as is shown in line C of FIG. 2.

The above-described operation has drawbacks, that is, the rapid cooling operation is carried out in spite of the pre-cooling operation when the rapid cooling operation is ordered while the pre-cooling operation is being carried out. Consequently, power consumption of the compressor is increased because of its excessive use and the freezing chamber is cooled excessively due to the continuous execution of the rapid cooling and pre-cooling operations.

SUMMARY OF THE INVENTION

The present invention provides a refrigerator having an improved control circuit which prevents the compressor from excessive operation, and also prevents a freezing chamber from excessive cooling.

The refrigerator of this invention includes a defrost control circuit which executes the rapid cooling operation, and then executes the defrost operation immediately after the completion of the rapid cooling operation. The pre-cooling operation is omitted if a rapid cool signal and defrost signal are produced to over-lap one another.

BRIEF DESCRIPTION OF THE ACCOMPANYING DRAWINGS

Other features and advantages of the present invention will be apparent from the following description taken in connection with the accompanying drawings wherein.

DETAILED DESCRIPTION OF THE PREFERRED EMBODIMENT

A preferred embodiment of the present invention will now be described in more detail with reference to the accompanying drawings.

Figure 3:
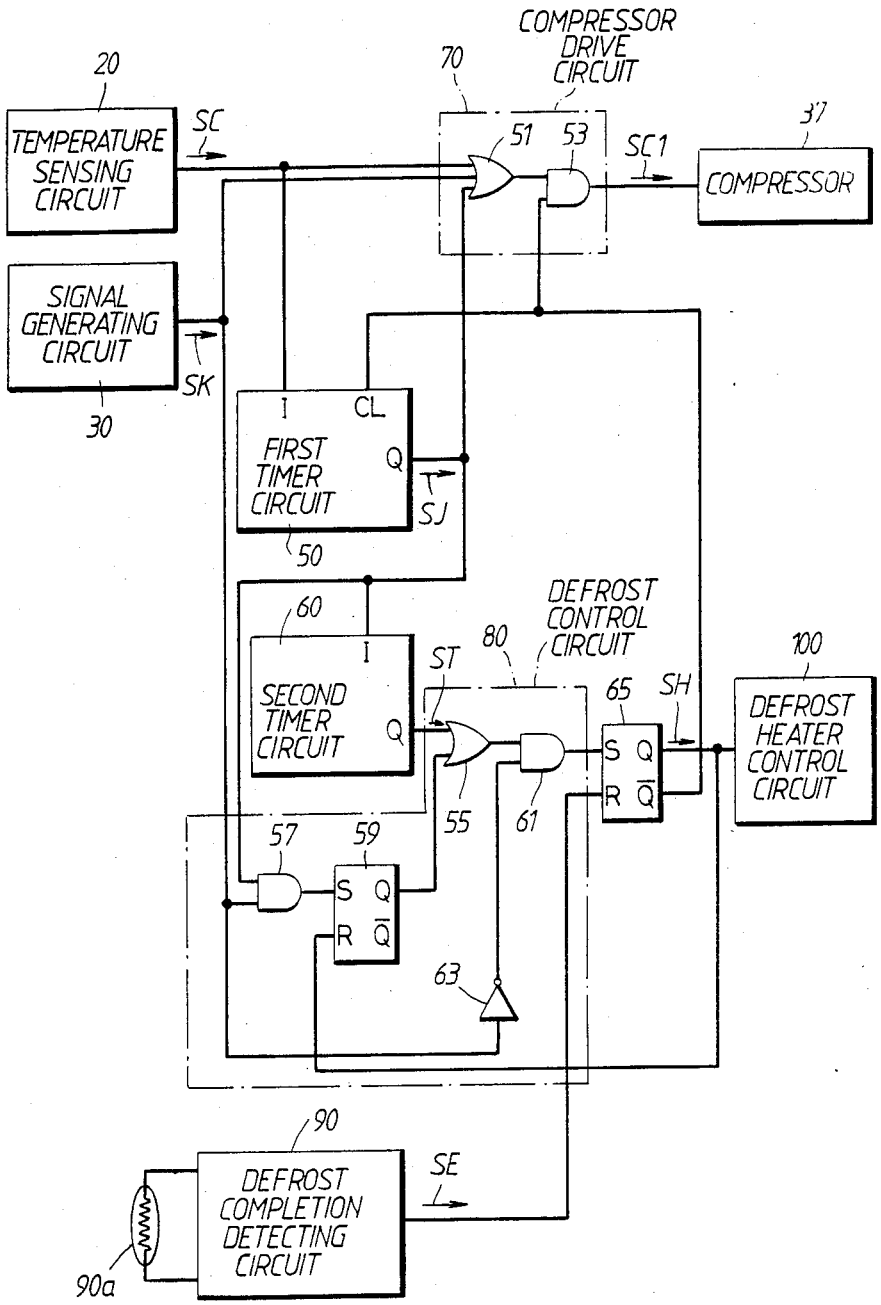
FIG. 3 is a logic circuit in accordance with one embodiment of the present invention.

In FIG. 3, a first timer circuit 50 includes an up-type counter for counting the output period of time of a high-level compressor control signal SC i.e., the operation time of the compressor. Circuit 50 is formed with two inputs I and CL and one output Q. The input I of first timer circuit 50 is connected to one of the inputs of an OR gate 51. Input CL is connected to one of the inputs of an AND gate 53, and output Q of first tuner circuit 50 is connected to a second input of OR gate 51.

First timer circuit 50 counts the pulses to record the period of time that high-level compressor control signal SC is fed from temperature sensing circuit 20 to the input I of first timer circuit 50 and produces a high-level defrost signal SJ from its output Q when the accumulated time of the high-level compressor control signal SC has reached a prescribed value, e.g. 24 hours. The defrost signal SJ shifts to a low-level when the up counter of first timer circuit 50 is cleared in response to a high level signal fed to the input CL thereof. The above described compressor control signal SC is produced by temperature sensing circuit 20 when the temperature of the freezing chamber has reached a prescribed upper-limit temperature, and is stopped when the temperature has reached a prescribed lower-limit temperature.

A second timer circuit 60 also includes an up-type counter to control the pre-cooling operation. An input I of second timer circuit 60 is connected to the output Q of first timer circuit 50 and an output Q of second timer circuit 60 is connected to one of the inputs of an OR gate 55. The second timer circuit 60 begins its count operation when the input I thereof receives a high-level defrost signal SJ from the output Q of first timer circuit 50, and produces a high-level pre-cooling stop signal ST from the output Q of second timer circuit 60 when the counting reaches a prescribed value.

A compressor drive control circuit 70 includes OR gate 51 and AND gate 53. Another input of the OR gate 51 receives a rapid cooling signal SK and one of the inputs thereof receives the compressor control signal SC. A high-level rapid cooling signal SK is produced from a signal generating circuit 30 when a user operates a switch (not shown) for rapid cooling. The output of OR gate 51 is connected to another input of AND gate 53.

As can be seen in FIG. 3, defrost control circuit 80 includes an AND gate 57, flip-flop circuit 59, OR gate 55, AND gate 61 and NOR gate 63. One of the inputs of AND gate 57 is connected to the output Q of first timer circuit 50 to receive the high-level defrost signal SJ therefrom. Another input of AND gate 57 is connected to another input of OR gate 51 and receives the rapid cooling signal SK. The other input of AND gate 57 is also connected to one of the inputs of AND gate 61 through NOR gate 63. The output of AND circuit 57 is connected to the set-input S of flip-flop 59. The set-output Q of flip-flop 59 is connected to another input of OR circuit 55. The output of OR gate 55 is connected to another input of AND gate 61. The output of AND gate 61 is connected to the set-input S of a flip-flop 65, and the reset input R of flip-flop 65 is connected to a defrost completion detecting circuit 90 (including a temperature sensor 90*a*). The set-output Q of flip-flop 65 is connected to a defrost heater control circuit 100 and also connected to the reset input R of flip-flop 59. The reset output $\overline{Q}$ of flip-flop 65 is connected to the input CL of first timer circuit 50.

Figure 1:
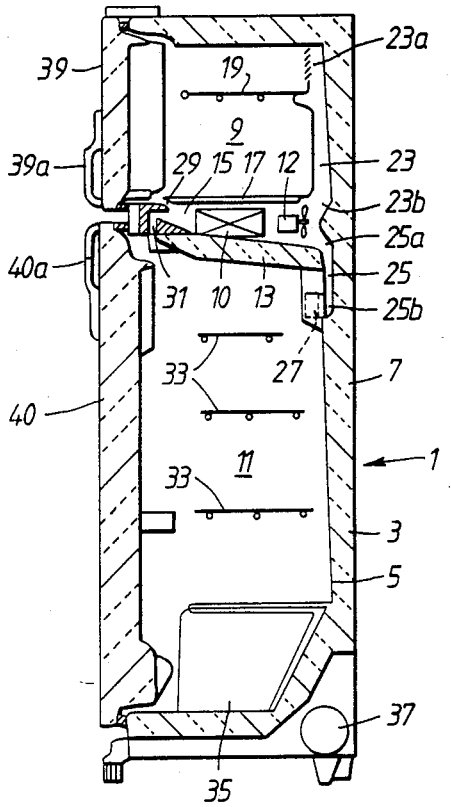
PRIOR ART FIG. 1.
FIG. 1 is a vertical side sectional view of a prior art refrigerator.

Flip-flop circuit 65 outputs a high-level defrost heating signal SH from its set-output Q to defrost heater control circuit 100 (including a defrost heater (not shown) attached to the evaporator shown in FIG. 1) to operate the defrost heater when the set input thereof receives an output signal from AND gate 61. The reset-output $\overline{Q}$ of flip-flop 65 outputs a high-level reset signal to one of the inputs of AND gate 53 and also the input CL of first timer circuit 50 when the set-input R of flip-flop 65 receives a high-level defrost completion signal SE from defrost completion detecting circuit 90. Defrost completion detecting circuit 90 produces a high-level defrost completion signal SE when the detected temperature of sensor 90*a*, which detects the temperature of evaporator 10, has reached a prescribed level.

The operation of the above-mentioned circuit will be described in more detail. In regular operation (neither the defrost operation nor rapid cooling operation are executed), the reset-output $\overline{Q}$ of flip-flop 65 outputs a high-level signal to the one of the inputs of AND gate 53. Another input of AND gate 53 receives the high-level compressor control signal SC produced in response to temperature variation of freezing chamber 9 (shown in FIG. 1) through OR gate 51. AND gate 53 therefore produces a high-level compressor drive signal SCl in response to the compressor control signal SC thereby driving compressor 37 (shown in FIG. 1). As mentioned previously, cooled air is therefore provided to not only freezing chamber 9 but also refrigerating chamber 11 via respective air circulation paths.

At the same time, first timer circuit 50 counts the output period of time of high-level compressor control signal SC. When the accumulated count value of first timer circuit 50 has reached the prescribed value, first timer circuit 50 outputs a high-level defrost signal SJ to second timer circuit 60 and OR gate 51. Thus the pre-cool operation begins.

Second timer circuit 60 therefore starts its count operation. The high-level defrost signal SJ is also fed through OR gate 51 to AND gate 53, which produces compressor drive signal SCl. Consequently, the pre-cooling operation is begun by forcibly driving the compressor 37 irrespective of the existence of compressor control signal SC.

When the accumulated value of second timer circuit 60 has reached a predetermined value, second timer circuit 60 outputs a high level pre-cooling stop signal ST from its output Q to the input of OR gate 55 of defrost control circuit 80, and then OR gate 55 feeds a high-level signal to one of the inputs of AND gate 61. In this case, as the rapid cooling signal SK is not present, a high level signal inverted through NOT gate 63 is being fed to another input of AND gate 61. AND gate 61 outputs a high-level signal to the set input S of flip-flop 65. Thus, flip-flop 65 is set, and then a reset signal from the reset output $\overline{Q}$ thereof is turned into a low-level signal.

AND gate 53 therefore stops the output of the compressor drive signal SCl, so that the pre-cool operation is completed. At the same time, a high level set signal (i.e., the defrost heating signal SH) is fed from the set output of flip-flop 65 to defrost heater control circuit 100 so that the defrost is now executed, as shown in line A of FIG. 2. Furthermore, since the output signal from the reset output $\overline{Q}$ of flip-flop 65 is a low-level signal the accumulated count value of first timer circuit 50 is cleared and defrost signal SJ from the output Q of first timer circuit 50 is stopped.

As mentioned previously, the high-level defrost completion signal SE is now fed from defrost completion detecting circuit 90 to the reset input R of flip-flop 65 when the detected temperature of sensor 90*a* has reached a prescribed level. Consequently, on the one hand the set output signal from the set output Q of flip-flop 65 is shifted into a low-level and the output of the defrost heating signal SH is stopped so that defrosting is completed. On the other hand, the reset output signal from the reset output $\overline{Q}$ of flip-flop 65 is shifted into a high-level, so that compressor 37 is controlled only in response to the compressor control signal SC.

If rapid cooling signal SK is produced while regular cooling is being carried out, both the rapid cooling signal SK and compressor control signal SC are fed to AND gate 53. AND circuit 53 outputs the compressor drive signal SCl, and rapid cooling is begun, as shown in line E of FIG. 2. At this moment, another input of AND gate 61 of the defrost control circuit 80 is supplied with a low-level rapid cooling signal SK inverted through NOT gate 63 so that the set output S of flip-flop 65 is at a low level and the reset output $\overline{Q}$ thereof is at a high-level.

If the defrost signal SJ is produced from first timer circuit 50 when the rapid cooling operation is being carried out, the output signal of AND gate 57 is inverted into a high-level and thus a high-level set output signal is produced from the set output Q of flip-flop 59. Since the input of AND gate 61 receives the high-level set output signal from flip-flop 59 through OR gate 55 on one hand and another input thereof receives the low-level rapid cooling signal SJ through NOT gate 63, the output of AND gate 61 is still at a low-level. The input-output state of flip-flop gate 65 is not changed therefore. Despite second timer circuit 60 beginning its counting operation as described above, the rapid cooling operation is executed preferentially.

When rapid cooling signal SK is extinguished, a high level signal is supplied to the other input of AND circuit 61 through NOT circuit 63, and then AND circuit 61 feeds a high level output signal to the set input S of flip-flop circuit 65 so that flip-flop circuit 65 outputs the high-level defrost heating signal SH from its set output Q to defrost heater control circuit. As can be understood from the above-description, the defrost operation (excluding the pre-cooling operation) is carried out as soon as rapid cooling signal SK is stopped when defrost signal SJ is produced during execution of the rapid cooling operation.

Figure 2:
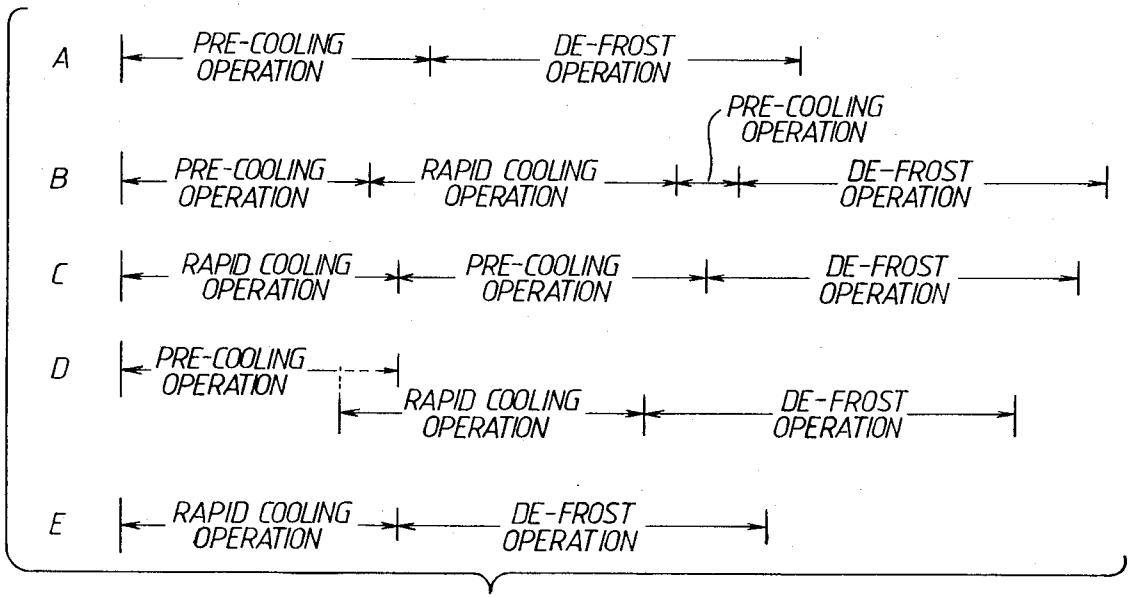
FIG. 2 is timing chart of refrigerator operations (pre-cooling, defrost cooling and rapid cooling)

As can be seen in D of FIG. 2, if rapid cooling signal SK is produced when defrost signal SJ is being fed from first timer circuit 50 (the pre-cooling operation is being carried out), compressor 37 is driven in response to defrost signal SJ and rapid cooling signal SK, and the rapid cooling signal SK (low-level) through NOT circuit 63 is supplied to another input of AND circuit 61 thereby keeping the set output Q of flip-flop circuit 65 at a low-level. The rapid cooling operation is therefore executed even though a high-level pre-cooling step signal ST is produced from second timer circuit 60, as is shown in D of FIG. 2.

If rapid cooling operation signal SK is stopped, a high-level signal is supplied through NOR gate 63 to another input of AND gate 61, and the output of AND circuit 61 feeds a high-level signal to the input S of flip-flop circuit 65. As a result, the set output S of flip-flop circuit 65 produces defrost heating signal SH and the reset output $\overline{Q}$ thereof stops it output signal. Consequently, an input signal fed to one of the inputs of AND circuit 53 is turned into a low-level signal and the output signal of AND circuit 53 (compressor drive signal SCl) is turned into a low-level signal. Thus, compressor 37 is stopped. As can be understood from the above-description, the defrost operation excluding the pre-cooling operation is executed as soon as the rapid cooling signal SK is produced while the defrost signal is produced (i.e., the pre-cool operation is executed).

In summary, it will be seen that the present invention overcomes the disadvantages of the prior art and provides a defrost control circuit which preferentially executes the rapid cooling operation if a rapid cooling signal and defrost signal are produced to over-lap one another, and then executes the defrost operation after the rapid cooling operation is completed. The pre-cooling operation to be executed after the completion of the rapid cooling operation is therefore omitted, thereby preventing the compressor from excessive driving, saving power consumption and also preventing the freezing chamber from excessive cooling.

Thus, while the present invention has been disclosed in what is presently conceived to be the most preferred embodiments thereof, those in the art may recognize that many modifications may be made which shall be accorded the broadest scope of the appended claims so as to encompass all equivalent structures and assemblies.

What is claimed is:

1. A refrigerator comprising:

means defining space to be cooled;

an evaporator for cooling said space;

a compressor for providing refrigerant to said evaporator;

means for defrosting said evaporator;

means for producing a defrost signal at predetermined times;

means for sensing the temperature in said space and producing a refrigerating signal;

means for producing a rapid cooling signal; and circuit means for operating said compressor to cool said space in response to said rapid cooling signal, said refrigerating signal or said defrosting signal, and for operating said defrosting means and stopping said compressor a predetermined time after said defrost signal when said rapid cooling signal is not produced to precool said space and immediately after rapid cooling when said defrost signal is produced during rapid cooling.

2. A refrigerator comprising:

means defining a space to be cooled;

a compressor and a control circuit for carrying out a rapid cooling function and an automatic defrost function including a precooling step, including:

means for producing a defrost signal at predetermined times;

means for producing a rapid cooling signal;

timer means responsive to said defrost signal for producing a stop signal a predetermined time following said defrost signal;

defrost completion circuit means for producing a defrost completion signal;

means for sensing temperature within said refrigerator and producing a refrigeration signal when said temperature is above a given value;

circuit means responsive to said stop signal and the absence of said rapid cooling signal, for producing a defrost heating signal to cause defrosting, and responsive to said defrost signal, when said defrost signal is produced substantially immediately after said rapid cooling signal is removed, to produce said defrost heating signal to cause defrosting; and compressor drive circuit means responsive to said refrigeration signal for operating said compressor, responsive to said rapid cooling signal for operating said compressor, and responsive to said defrost signal for operating said compressor, and responsive to said defrost heating signal for stopping operation of said compressor.

3. A control circuit for a refrigerator of the type having a rapid cooling function and an automatic defrost function including a precooling step and having a compressor, comprising:

means for producing a defrost signal at predetermined times;

means for producing a rapid cooling signal;

timer means responsive to said defrost signal for producing a stop signal a predetermined time following said defrost signal;

defrost completion circuit means for producing a defrost completion signal;

means for sensing temperature within said refrigerator and producing a refrigeration signal when said temperature is above a given value;

circuit means responsive to said stop signal and the absence of said rapid cooling signal, for producing a defrost heating signal to cause defrosting, and responsive to said defrost signal, when said defrost signal is produced substantially immediately after said rapid cooling signal is removed, to produce said defrost heating signal to cause defrosting; and compressor drive circuit means responsive to said refrigeration signal for operating said compressor, responsive to said rapid cooling signal for operating said compressor, and responsive to said defrost signal for operating said compressor, and responsive to said defrost heating signal for stopping operation of said compressor.

4. A method of operating a refrigerator comprising the steps of:

producing a defrost signal at predetermined times;

producing a rapid cooling signal;

producing a stop signal a predetermined time following said defrost signal;

sensing temperature with said refrigerator and producing a refrigeration signal in response thereto;

operating a compressor to cool said refrigerator in response to said refrigeration signal, said rapid cooling signal or said defrost signal;

stopping said compressor and starting defrost heating in response to said stop signal when said rapid cooling signal is not being produced and in response to said defrost signal when said defrost signal is produced substantially immediately after said rapid cooling signal is removed.

* * * * *